US006431780B2

(12) United States Patent
Moor et al.

(10) Patent No.: US 6,431,780 B2
(45) **Date of Patent: *Aug. 13, 2002**

(54) NOTEBOOK WITH REMOVABLE SHEETS

(75) Inventors: Marc L. Moor, Oakwood, OH (US); Thomas DeBlasis, Pittsburgh, PA (US)

(73) Assignee: Bally Design Inc., Pittsburgh, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/461,462

(22) Filed: Dec. 14, 1999

Related U.S. Application Data

(60) Provisional application No. 60/124,943, filed on Mar. 18, 1999.

(51) Int. Cl.[7] ..... B42F 13/00

(52) U.S. Cl. ..... 402/79; 281/38

(58) Field of Search ..... 402/79, 80 R; 281/38, 15.1, 21.1, 36, 43, 45, 2, 51; 283/61

(56) References Cited

U.S. PATENT DOCUMENTS

| | | | | |
|---|---|---|---|---|
| 1,505,079 A | * | 8/1924 | Mills | 281/38 X |
| 3,315,684 A | | 4/1967 | Karl | 129/21 |
| 3,913,740 A | * | 10/1975 | Bisberg | 402/79 X |
| 4,127,690 A | * | 11/1978 | Schleifenbaum et al. | 402/79 |
| 4,395,059 A | | 7/1983 | Russell, III | 282/29 B |
| 4,492,487 A | | 1/1985 | Spear | 402/79 |
| 4,773,676 A | | 9/1988 | Showering | 281/2 |
| 4,802,692 A | | 2/1989 | Stryd | 281/5 |
| 5,524,998 A | * | 6/1996 | Schwartz | 281/21.1 |
| 5,836,711 A | | 11/1998 | Stewart | 402/79 |

FOREIGN PATENT DOCUMENTS

| | | |
|---|---|---|
| CH | 488571 | 5/1970 |
| DE | 862596 | 1/1953 |
| DE | 29513501 | 10/1995 |
| FR | 1017133 | 12/1952 |

* cited by examiner

*Primary Examiner*—William Fridie, Jr.
(74) *Attorney, Agent, or Firm*—Thompson Hine LLP

(57) ABSTRACT

A paper sheet comprising a sheet having a first set of holes for receiving an external binder therethrough and a second set of holes for receiving an external binder therethrough. The second set of holes are laterally aligned with the first set of holes. The sheet further includes a set of perforations extending between the first and second set of holes such that a portion of the sheet containing the second set of holes may be manually separated from a portion of the sheet containing the first set of holes.

29 Claims, 3 Drawing Sheets

NOTEBOOK WITH REMOVABLE SHEETS

This application claims priority to U.S. Provisional Application Ser. No. 60/124,943, filed Mar. 18, 1999, the contents of which are hereby incorporated by reference.

The present invention is directed to a notebook, and more particularly, to a notebook having a plurality of removable paper sheets.

BACKGROUND OF THE INVENTION

Notebooks are commonly used by students in educational settings such as schools and universities. The notebooks typically are made up of plurality paper sheets and include a binding that binds the sheets together. The notebook may include a set of holes through its thickness so that the notebook can be received in a conventional external binder, such as a three ring binder. The rings of the external binder are passed through the holes in the notebook to attach the notebook to the external binder. A line of perforations may be provided in each sheet in the notebook such that a portion of the paper can be neatly torn away from the notebook. The perforations are typically located between the binder-receiving holes and the edge of the paper. Thus, when such a notebook is retained in a three ring binder, in order to remove a sheet of paper the notebook must be removed from the external binder before the sheet can be torn along its perforations and removed. This requires additional time and effort to remove the sheet of paper, and increases the wear upon the binding mechanism in the external binder.

U.S. Pat. No. 4,773,676 to Showering discloses sheets of continuous stationary that can be divided into individual sheets. Each sheet 10 includes a set of longitudinally-extending holes located along the longitudinal edges 17, 19 of the sheet 10. The holes adjacent the edges 17, 19 are feed holes that are shaped to interact with a feed wheel in printers, accounting machines, and the like for advancing the sheets 10. Thus the feed holes are not located to receive a standard sized binder, and therefore the sheets 10 shown in the Showering reference cannot be mounted into a standard-sized binder. A second set of longitudinally-extending set of holes 27 are located adjacent a longitudinally-extending score line 16. The second set of holes 27 are also not located to receive a standard sized binder, and therefore the torn sheets provided by the sheet 10 can not be received in a standard sized binder. Accordingly, there is a need for a notebook that can be received in an external binder, wherein the notebook that provides sheets of paper that can be removed from the folder without having to open the binding mechanism of the external binder. It is further preferred that the removed sheets be shaped to be received in a conventional external binder after the sheets have been removed from the notebook.

SUMMARY OF THE INVENTION

The present invention is a notebook which can be received in an external binder, and which provides sheets that can be removed from the notebook without opening the binding mechanism of the external binder. The removed sheets can themselves be received in an external binder after they have been removed from the notebook.

More particularly, the present invention is a notebook comprising a plurality of paper sheets. Each of the sheets includes a first set of holes for receiving an external binder therethrough, the first set of holes having a longitudinal spacing pattern. Each sheet also includes a second set of holes for receiving an external binder therethrough, the second set of holes having a longitudinal spacing pattern corresponding to the longitudinal spacing pattern of the first set of holes. Each sheet includes a set of perforations extending between the first and second set of holes such that a portion of the sheet containing the second set of holes may be manually separated from a portion of the sheet containing the first set of holes. The notebook also includes binding means for binding the plurality of sheets together.

The present invention is also directed to a single paper sheet. In this embodiment, the invention is a paper sheet comprising a first set of holes for receiving an external binder tberethrough and a second set of holes for receiving an external binder therethrough. The second set of holes are laterally aligned with the first set of holes. The sheet further includes a set of perforations extending between the first and second set of holes such that a portion of the sheet containing the second set of holes may be manually separated from a portion of the sheet containing the first set of holes.

Other objects and advantages of the present invention will be apparent from the following description and the accompanying drawings.

DETAILED DESCRIPTION

Figure 1:
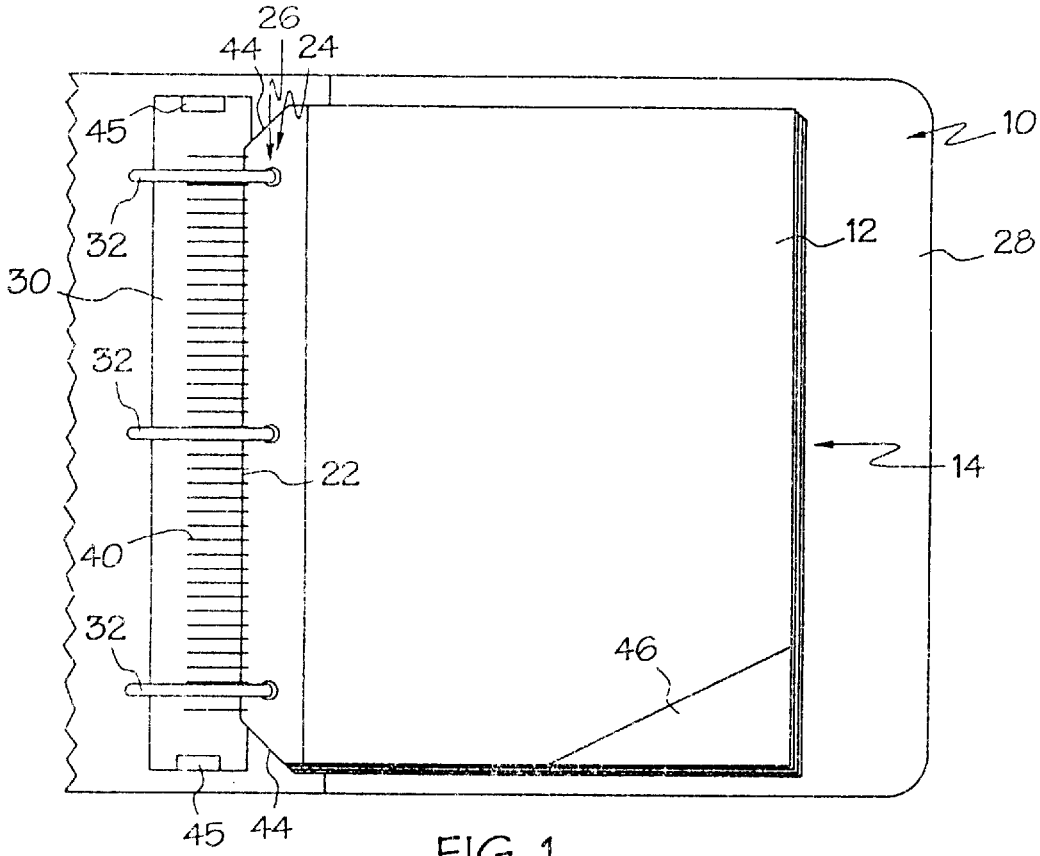
FIG. 1 is a front view of the notebook of the present invention received in an external binder.
Figure 2:
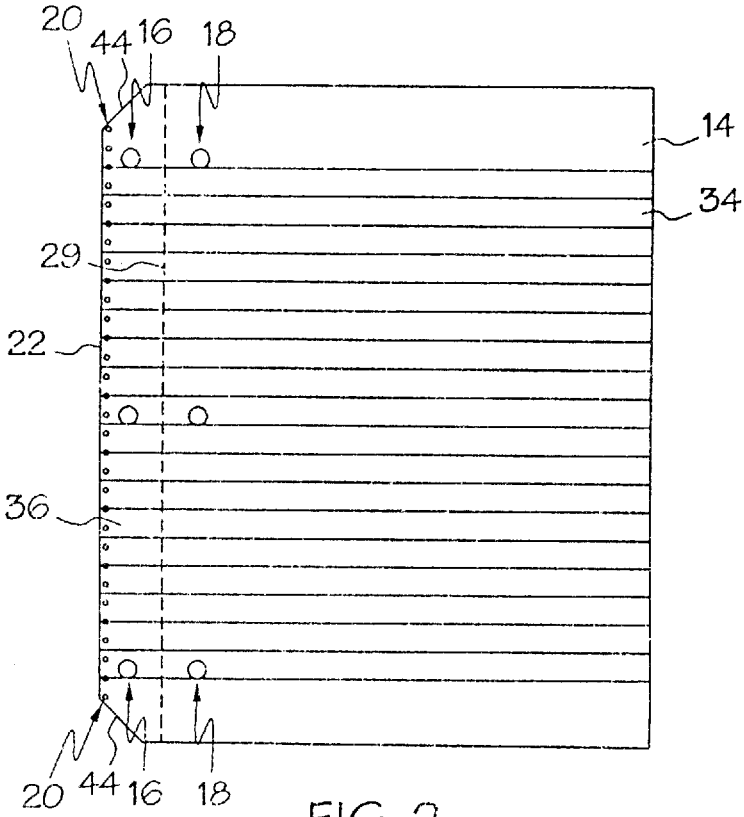
FIG. 2 is a front view of a sheet of paper of the notebook of FIG. 1.

As shown in FIG. 1, the notebook 10 of the present invention includes a cover 12 and a plurality of sheets 14. As shown in FIG. 2, each sheet 14 includes a first 16 and a second 18 set of holes, as well as a set of binder holes 20. Each set of holes 16, 18, 20 extends longitudinally along an inner edge 22 of the sheet 14. The cover 12 similarly includes first set of holes 24 and a set of binder holes 26 that correspond to the first set of holes 16 and binder set of holes 20 in the paper sheets 14 (FIG. 2). The first sets of holes 16, 24 are shaped and located to mount the notebook 10 onto an external binder, such as a conventional, three ring binder 28 having a binding mechanism 30. Thus, as shown in FIG. 1, each of the rings 32 of the three ring binder 28 are received through the first set of holes 24, 16. With reference to FIG. 2, the second sets of holes 18 are also shaped and located to mount the sheet onto an external binder, such as the three ring binder 28.

Figure 3:
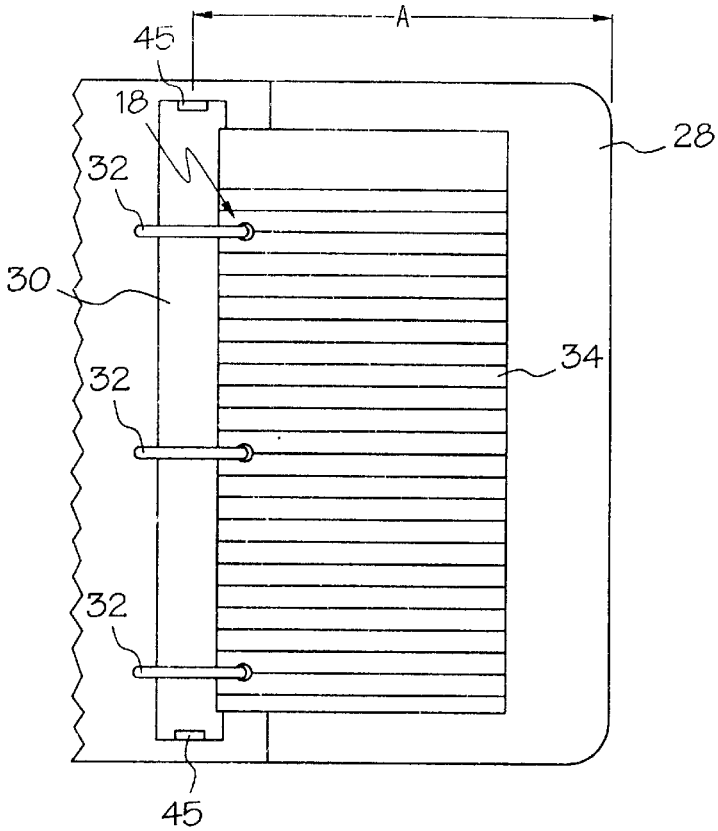
FIG. 3 is a front view of the torn sheet of FIG. 2 received in the external binder of FIG. 1.

The notebook 10 can be maintained in an external binder 28 by passing the rings 32 of the binding mechanism 30 through the first set of holes 16, 24. A longitudinally extending set of perforations 29 is located between the first 16 and second 18 sets of holes on each sheet 14. When mounted in an external binder 28, the outer portions 34 of the sheets 14 can be removed by tearing the sheets 14 along the set of perforations 29 or other tearing guide. In this manner the binding mechanism 30 need not be opened to enable the torn sheet 34 to be removed from the notebook 10. Once the outer portion 34 is separated from the inner portion 36 of the sheet 14, the outer portion 34 (also termed the torn sheet 34) can be stored in the three ring binder 28 by passing the rings 32 of the external binder 28 through the second set of holes 18 as shown in FIG. 3. In this manner, after the torn sheet 34 is removed from the notebook 10, it may be stored in the same three ring binder 28 that receives the notebook 10, as well as a different notebook The first 16 and second 18 sets of holes in each sheet 14, as well as the first set of holes 24 in the cover 12, preferably each include three holes equally spaced apart about by about 4.25 inches, which is the standard three ring binder spacing. However, other arrangements and spacings of the first and second sets of holes may be utilized as may be desired to mount the notebook 10, cover 12, sheet 14 and/or torn sheets 34 to various types of binders and mounting mechanisms. Preferably, the first set of holes 16 is laterally aligned with the second set of holes 18. Alternately, the second set of holes 18 has a longitudinal spacing pattern that corresponds to the longitudinal spacing pattern of the first set of holes 16. In this manner, even if the second set of holes 18 do not laterally correspond to the first set of holes 16, the torn sheet 34 can be received in the same external binder 28 in which the notebook 10 can be received. In yet another embodiment, the second set of holes 18 in the sheets 14 may be located adjacent the right hand edge of the paper sheet 14 of FIG. 2.

As noted earlier, each sheet 14 may also include a binder set of holes 20 shaped and located to receive a notebook binder, such as a plastic spiral or coil binder 40 (FIG. 1) that are commonly used in the art. The spiral binder 40 is also passed through the binder holes 26 of the cover 12. The cover 12 may also alternately includes a second set of holes (not shown in FIG. 1) that correspond to the second set of holes 18 in the sheets 14. The cover 12 may also include a set of perforations 54 (see FIG. 4) such that a portion of the cover 12 can be removed.

The cover 12 and each of the sheets 14 preferably includes a chamfered edge 44 adjacent the inner edge 22 of the cover 10 and sheets 14. The chamfered edge 44 helps to avoid interference between the cover 12 and the binding mechanism 30 and the sheets 14 and the binding mechanism 30. For example, the binding mechanism 30 may include a lever 45 for opening and closing the binding mechanism 30, and the chamfered edge 44 reduces the interference between the sheets 14 and lever 45. The torn sheets 34 may also include chamfered inner corners (not shown).

As shown in FIG. 1, the outer surface of the cover 12 also preferably includes a pocket 46 that is formed by a piece of material mounted onto a corner of the cover 12. The material forming the pocket 46 is preferably transparent to enable a label having written indicia thereon to be slid underneath the material to identify the notebook 10. The external binder 28 shown in FIGS. 1 and 3 may have an extra width A as compared to conventional external binders. In this manner the external binder 28 may accommodate the notebook 10 of the present invention which may also have an extra width as compared to conventional notebooks.

Figure 4:
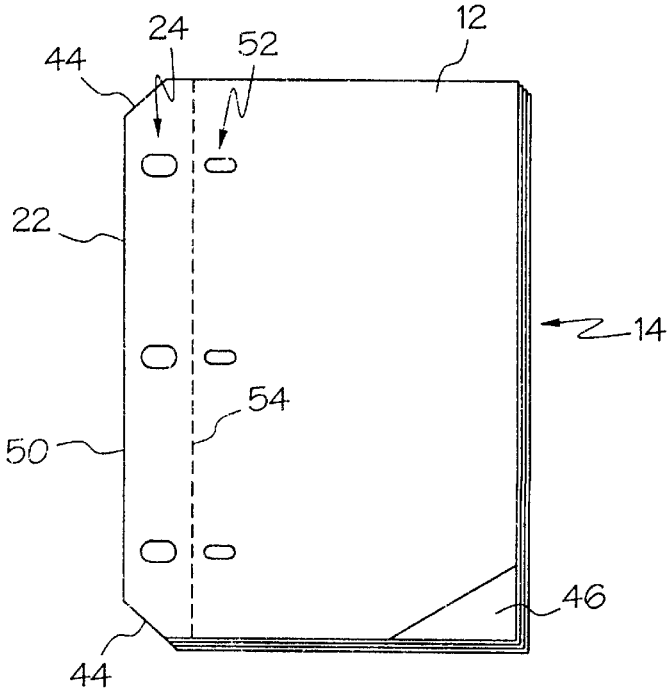
FIG. 4 is a front view of an alternate embodiment of the notebook of the present invention.

The spiral binder 40 of may be replaced with nearly any mechanism for binding the sheets of paper 14 together. For example, as illustrated in FIG. 4, the sheets 14 may be bound by an adhesive 50 applied to the inner edge 22 of the sheets 14 and cover 12. The adhesive 50 bonds the inner edges 22 of the sheets 14 and cover 12 together to form a relatively rigid spine. Of course, in this embodiment the binding sets of holes 20, 26 are not required in the sheets 14 or in the cover 12. Alternately, any of a wide variety of binding means can be mounted on, or adjacent to, the inner edge of the sheets 22 to bind the sheets 14 together.

In the embodiment of FIG. 4 the cover 12 of the notebook includes a second set of holes 52 that corresponds to the second set of holes 18 in the sheets 14. Although the sheets 14 are not visible, the sheets 14 each include a first set of holes 16 that correspond to the first set of holes 24 of the cover 12 shown in FIG. 4, and a second set of holes 18 that correspond to the second set of holes 52 in the cover 12 shown in FIG. 4. In this embodiment, the holes 16, 18 in each of the sheets 14, as well as the holes 24, 52, in the cover 12, are generally oval-shaped. The first set of holes 16, 24 are a relatively wide oval shape so that the notebook can be received in binders having various sizes and widths of binding mechanisms. The second set of holes 18, 52 are a relatively narrow oval shape. The extra length provided by the oval holes, as compared to circular holes, make it easier for a user to fit the rings of a binder into the oval holes. The width of the ovals forming the second set of holes 18, 52 is preferably about the same as the thickness of the rings 32 of the binding mechanism such that the rings 32 are closely received in the torn sheet 34.

Figure 5:
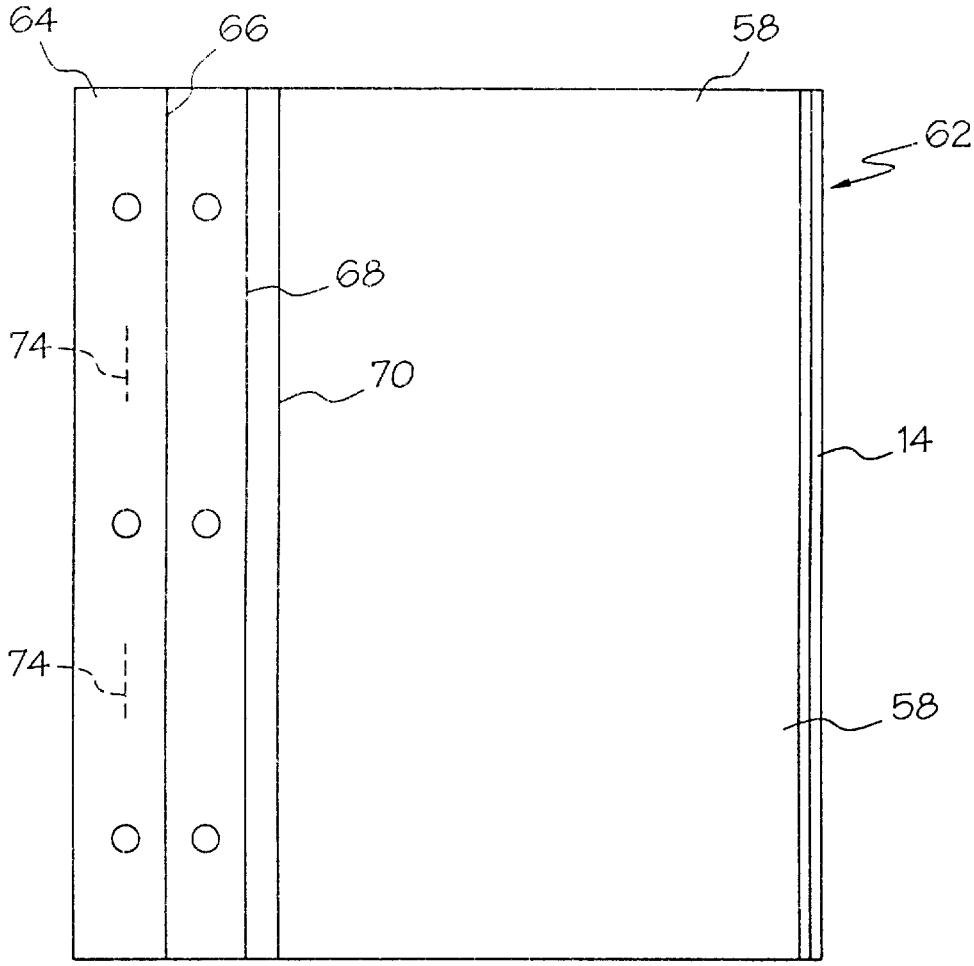
FIG. 5 is a front view of another alternate embodiment of the notebook of the present invention.
Figure 6:
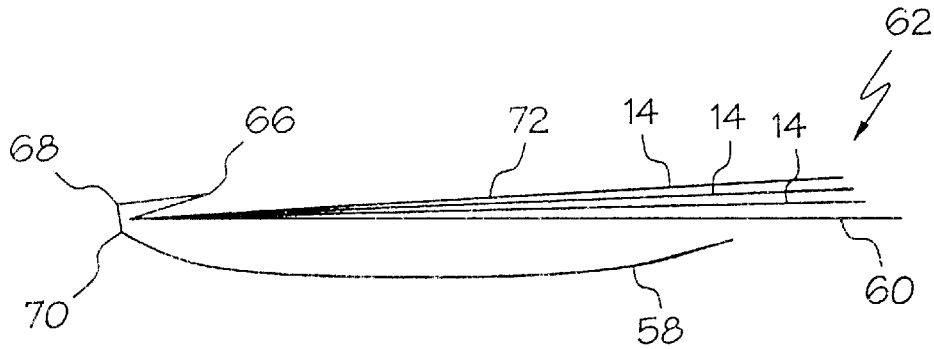
FIG. 6 is an end view of the notebook of FIG. 5, with the cover folded around the body of the notebook.

FIGS. 5–6 illustrates yet another alternate embodiment in which the notebook 62 is bound by a set of staples 74 that are passed through the cover 58 of the notebook and each of the sheets 14. The staples 74 are then covered by an adhesive strip 64. The cover 58 is made of cardboard, plastic, or another sufficiently pliable material and includes a set of longitudinally-extending fold lines 66, 68, 70. The fold lines 66, 68, 70 enable the top cover 58 of the notebook 62 to be wrapped around the bottom cover 60 of the notebook, as shown in FIG. 6. The design of the top cover 58 thereby enables a user to fold the top cover 58 under the bottom of the notebook to keep the top cover 58 underneath the notebook 10 so that a user can write upon the top sheet 72 of the notebook 62.

Having described the invention in detail and by reference to the preferred embodiments, it will be apparent that modifications and variations thereof are possible without departing from the scope of the invention.

What is claimed is:

1. A paper sheet for use in a notebook comprising a sheet having a first set of holes for receiving an external binder therethrough, a second set of holes for receiving an external binder therethrough, said second set of holes being laterally aligned with said first set of holes, a set of perforations extending between said first an second set of holes such that a portion of said sheet containing said second set of holes may be manually separated from a portion of said sheet containing said first set of holes, said first set of holes having a one-on-one correspondence with said second set of holes, and wherein said paper sheet includes a plurality of longitudially extending areas in which no holes are located, each longitudinally extending area being located between adjacent holes of each set of holes, and third set of holes located between said first set of holes and an edge of said sheet for receiving a binder therethrough that binds said sheet to a plurality of other sheets.

2. The paper sheet of claim 1 wherein said first set of holes are spaced apart to receive a three ring binder therethrough, and wherein said second set of holes are spaced apart to receive a three ring binder therethrough.

3. The paper sheet of claim 2 wherein said first and second sets of holes each include three holes that are evenly spaced apart by about 4.25 inches.

4. The paper sheet of claim 1 wherein said sheet is shaped to receive a means for binding said sheet to a plurality of other sheets.

5. The paper sheet of claim 4 wherein said binding means is a spiral binder.

6. The paper sheet of claim 1 wherein said third set of holes are shaped to receive a spiral binder therein.

7. The paper sheet of claim 1 wherein said sheet includes a pair of chamfered corners adjacent said first set of holes to reduce interference between said sheet and an external binder which receives said sheet.

8. The paper sheet of claim 1 wherein said first and second set of holes are generally oval-shaped.

9. The paper sheet of claim 8 wherein the height of said second set of holes are about the same as the thickness of the portion of said external binder received therethrough, and wherein the height of said first set of holes is greater than the thickness of the portion of the external binder.

10. A notebook comprising:

a plurality of paper sheets, each of said sheets having a) a first set of holes for receiving an external binder therethrough, said first set of holes having a longitudinal spacing pattern;

b) a second set of holes for receiving an external binder therethrough, said second set of holes having a longitudinal spacing pattern corresponding to the longitudinal spacing pattern of said first set of holes; and c) a set of perforations extending between said first and second set of holes such that a portion of said sheet containing said second set of holes may be manually separated from a portion of said sheet containing said first set of holes; and binding means for binding said plurality of sheets together.

11. The notebook of claim 10 wherein said first set of holes is laterally aligned with said second set of holes in each sheet.

12. The notebook of claim 10 wherein said binding means is a spiral binder passed through each of said sheets.

13. The notebook of claim 10 wherein said binding means is an adhesive that adheres said sheets together.

14. The notebook of claim 10 wherein said binding means includes a set of staples passed through said sheets and an adhesive strip covering said set of staples.

15. The notebook of claim 10 wherein said first set of holes in each sheet extends along an edge of said sheet, and wherein said binding means binds said sheets together along said edge.

16. The notebook of claim 10 wherein each of said sheets further includes a pair of chamfered corners on an edge of said sheet adjacent said binding means to reduce interference between said sheets and an external binder which receives said notebook.

17. The notebook of claim 10 further comprising a top cover for protecting said plurality of sheets.

18. The notebook of claim 17 further comprising a pocket on said top cover for receiving a piece of sheet like material including identifying indicia thereon.

19. The notebook of claim 18 wherein said pocket is made of a generally transparent material.

20. The notebook of claim 17 further comprising a bottom cover, and wherein said top cover includes a plurality of fold lines such that said top cover can be folder around said bottom cover to expose said sheets.

21. The notebook of claim 10 wherein said notebook can be retained in an external binder passed through said first set of holes, and wherein each sheet can be torn along said set of perforations such that said torn sheet can be retained in said external binder passed through said second set of holes.

22. The notebook of claim 10 wherein said first and second set of holes in each sheet are sized to receive a three ring binder therethrough.

23. The notebook of claim 10 wherein said first and second set of holes in each sheet each include three holes that are evenly spaced apart by about 4.25 inches.

24. The notebook of claim 10 wherein said first and second set of holes in each sheet and said set of perforations in each sheet extend generally longitudinally in said sheet.

25. A notebook comprising:

a plurality of paper sheets, each of said sheets having a) a first set of holes for receiving an external binder therethrough, said first set of holes having a longitudianl spacing pattern and being located adjacent an edge of said sheet;

b) a second set of holes for receiving an external binder therethrough, said second set of holes having a longitudinal spacing pattern corresponding to the longitudinal spacing pattern of said first set of holes, wherein a portion of said sheet containing said second set of holes may be manually separated from a portion of said sheet comtaining said first set of holes; and binding means for binding said plurality of sheets togehter.

26. The notebook of claim 25 wherein a binder can be received through said first set of holes, and wherein said portion of said sheet including said second set of holes can be manually separated from said portion of said sheet including said first set of holes without opening said binder.

27. The sheet of claim 1 wherein said sheet includes a plurality of guide lines extending across the width of said sheet, each guide line including a pair of end points, and wherein at least two of said first set of holes are each located adjacent to an end point of a respective one of said guide lines.

28. The notebook of claim 10 wherein each sheet includes a plurality of guide lines extending across the width of said sheet, each guide line including a pair of end points, and wherein at least two of said first set of holes are each located adjacent to an end point of a respective one of said guide lines.

29. The notebook of claim 27 wherein each sheet includes a plurality of guide lines extending across the width of said sheet, each guide line including a pair of end points, and wherein at least two of said first set of holes are each located adjacent to an end point of a respective one of said guide lines.

* * * * *

UNITED STATES PATENT AND TRADEMARK OFFICE

CERTIFICATE OF CORRECTION

PATENT NO. : 6,431,780 B2
DATED : August 13, 2002
INVENTOR(S) : Marc L. Moor et al.

It is certified that error appears in the above-identified patent and that said Letters Patent is hereby corrected as shown below:

Title page,
Item [73], Assignee, remove "Bally Design Inc." and insert -- The Mead Corporation --.

Column 4,
Line 44, change the word "an" to -- and --;
Line 48, change "one-on-one" to -- one-to-one --;
Lines 49-50, change "longitudially" to -- longitudinally --;

Column 6,
Lines 21-22, change "longitudianl" to -- longitudinal --.

Signed and Sealed this

Twelfth Day of November, 2002

*Attest:*

*Attesting Officer*

JAMES E. ROGAN
*Director of the United States Patent and Trademark Office*